US007356959B2

(12) United States Patent
Schmitter et al.

(10) Patent No.: US 7,356,959 B2
(45) Date of Patent: Apr. 15, 2008

(54) FIREARM AUTHORIZATION SYSTEM WITH PIEZO-ELECTRIC DISABLER

(75) Inventors: Edward P. Schmitter, Eastover, SC (US); Armand Gering, Liege (BE); Paul Michotte, Trooz (BE); Olivier Coulombier, Columbia, SC (US); Milton W. Erickson, Merrillan, WI (US); Jason L. Hitchcox, Columbia, SC (US); Patrick Heins, Liege (BE)

(73) Assignee: FN Herstal SA, Herstal (BE)

( * ) Notice: Subject to any disclaimer, the term of this patent is extended or adjusted under 35 U.S.C. 154(b) by 346 days.

(21) Appl. No.: 10/558,955

(22) PCT Filed: Jun. 4, 2004

(86) PCT No.: PCT/US2004/017620

§ 371 (c)(1),
(2), (4) Date: Nov. 30, 2005

(87) PCT Pub. No.: WO2005/005908

PCT Pub. Date: Jan. 20, 2005

(65) Prior Publication Data

US 2006/0242879 A1 Nov. 2, 2006

Related U.S. Application Data

(60) Provisional application No. 60/475,712, filed on Jun. 4, 2003.

(51) Int. Cl.
*F41A 17/08* (2006.01)
*F41A 17/28* (2006.01)
*F41A 17/56* (2006.01)

(52) U.S. Cl. ..... 42/70.05; 42/70.01; 42/70.09; 89/144; 89/146

(58) Field of Classification Search ..... 42/70.01, 42/70.05, 70.09, 70.11; 89/144, 146
See application file for complete search history.

(56) References Cited

U.S. PATENT DOCUMENTS

| | | | | |
|---|---|---|---|---|
| 4,003,152 | A | 1/1977 | Barker et al. | |
| 4,682,435 | A | 7/1987 | Heltzel | |
| 5,083,392 | A | 1/1992 | Bookstaber | |
| 5,564,211 | A * | 10/1996 | Mossberg et al. | 42/70.11 |
| 6,237,271 | B1 | 5/2001 | Kaminski | |
| 6,301,815 | B1 | 10/2001 | Sliwa | |
| 6,314,671 | B1 * | 11/2001 | Gering | 42/70.11 |
| 6,412,207 | B1 | 7/2002 | Crye et al. | |
| 6,735,897 | B1 | 5/2004 | Schmitter et al. | |
| 2001/0042332 | A1 | 11/2001 | Gering et al. | |
| 2002/0174588 | A1 | 11/2002 | Dannet et al. | |

* cited by examiner

*Primary Examiner*—Stephen M Johnson
(74) *Attorney, Agent, or Firm*—Michael A. Mann; Nexsen Pruet, LLC

(57) ABSTRACT

An authorization system for a firearm (10) includes an authorizing device (32) worn by the authorized user, and a firearm (10) with a fire control system, a computer controller (28), and a piezo-electric disabler (60). The computer controller (28) communicates with the authorizing device (32), and if no authorizing signal is received from the authorizing device, sends an electric output signal to the disabler (60) to prevent the fire control system from allowing the firearm to fire. The disabler, upon application of the electrical signal from the computer controller, cams the rearward moving trigger bar (52) of the fire control system clear of the hammer link (54) to disrupt the fire control system. Consequently, the firearm (10) will not fire.

11 Claims, 4 Drawing Sheets

FIREARM AUTHORIZATION SYSTEM WITH PIEZO-ELECTRIC DISABLER

This application is a 371 of PCT/US04/17620, filed on Jun. 4, 2004, which claims benefit from provisional application 60/475,712, filed on Jun. 4, 2003.

BACKGROUND OF THE INVENTION

The present invention relates to firearm safety in general and to firearms with authorization systems in particular.

There have been numerous improvements to firearm safety over the years. Historically, firearm safeties were of the type that, when the user wanted to fire the weapon, he or she moved a safety lever or catch from the "on" position to the "off"position. None of these safeties, however, questions the authority of the user who intends to fire the firearm. Any user may intentionally fire the firearm.

More recently, firearms have been designed with authorization systems. These systems attempt to verify that the user is permitted to fire the firearm. An unauthorized user cannot fire the firearm equipped with an authorization system. Typically, these systems rely on some means of identification: the user enters a code on a keypad on the firearm or has a key that unlocks the firearm, or the firearm has the capability to read a particular individual's fingerprint. Another type of authorization system relies on a "personal device" worn by the authorized user that communicates using radio-frequency transmitters and receivers with electronic circuits carried in the firearm.

Various design considerations must be taken into account when designing an authorization system particularly for law enforcement use. Authorization systems must be designed to be difficult for criminals to defeat. Police officers operate in different environments than users of target shooting pistols. Authorization systems that rely on battery power must have a ready-to-fire condition even if the battery is dead and ideally require only limited power so as to prolong battery life. Accordingly, there remains a need for an authorization system that operates reliably, that does not drain its batteries quickly, and that is particularly suited for law enforcement use.

SUMMARY OF THE INVENTION

According to its major aspects and briefly recited, the present invention is a firearm authorization system designed especially for law enforcement use. The system determines if the user is an authorized user, and, if so, permits the firearm to fire. If not authorized, the user will not be able to fire the firearm. The firearm authorization system includes a firearm with a fire control mechanism capable of firing ammunition, an on-board computer controller, and a disabler that responds to an electrical output signal from the on-board computer controller when the user is not authorized. A personal device is used to provide the authorized signal to the computer controller.

If an authorization signal is not obtained (either because no authorizing device is present to give an authorizing signal or no proper signal is received), pulling the trigger will not cause the firearm to discharge. Specifically, a failure to authorize causes the disabler to cam the trigger bar clear of the hammer so the trigger bar cannot engage and thereby load the hammer. On the other hand, if authorization is obtained, the enabler does not significantly affect the normal, rearward movement of the trigger bar, and the pulling of the trigger is translated into movement of the hammer until the sear trips and the hammer is released. The hammer then hits the firing pin, which strikes the primer and discharges the firearm.

The use of a piezo-electric-activated disabler is an important feature of the present invention. Upon receiving a small electrical signal indicating that the user is not authorized to fire the firearm, the piezo-electric disabler will cam the trigger bar away from engagement with the hammer. As a consequence, the hammer cannot be loaded in order to strike the firing pin. Once the signal that the user is not authorized is withdrawn, the trigger bar will be allowed to move rearward normally.

The combination of circuit logic and the type of enabler is another important feature of the present invention. In addition to having authorization logic oriented to best suit the needs of law enforcement personnel, the logic also minimizes battery consumption. For example, the power-consuming authorization process is only done when the gun is out of the holster and the firearm is being held in such a way as to indicate that the user may fire it. There is also a "sleep mode" when the gun is out of the holster but not within the user's grasp. In this mode it draws very little power. In the holster it draws none. Only when the person grasping the gun is not authorized, which is likely a very small percentage of the time, does the system require power for the enabler. Furthermore, use of a piezo-electric-based enabler draws very little power compared to disablers based on solenoids for example. Accordingly, in the case of battery failure, the firearm will fire because the system has been designed according to the police requirement to be "fail-fire".

Other features and their advantages will become apparent to those skilled in the art of firearm design from a careful reading of the Detailed Description of Preferred embodiments, accompanied by the following drawings.

BRIEF DESCRIPTION OF THE SEVERAL VIEWS OF THE DRAWINGS

In the figures.

DETAILED DESCRIPTION OF THE INVENTION

Figure 1:
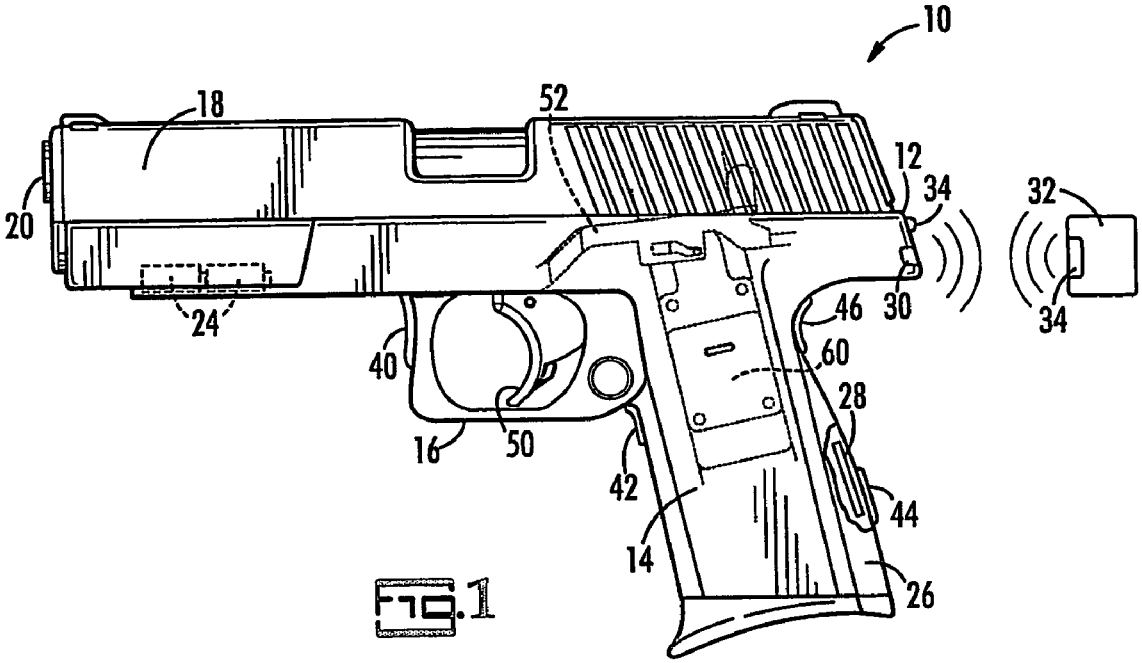
FIG. 1 is a side view of a firearm, according to a preferred embodiment of the present invention.
Figure 2:
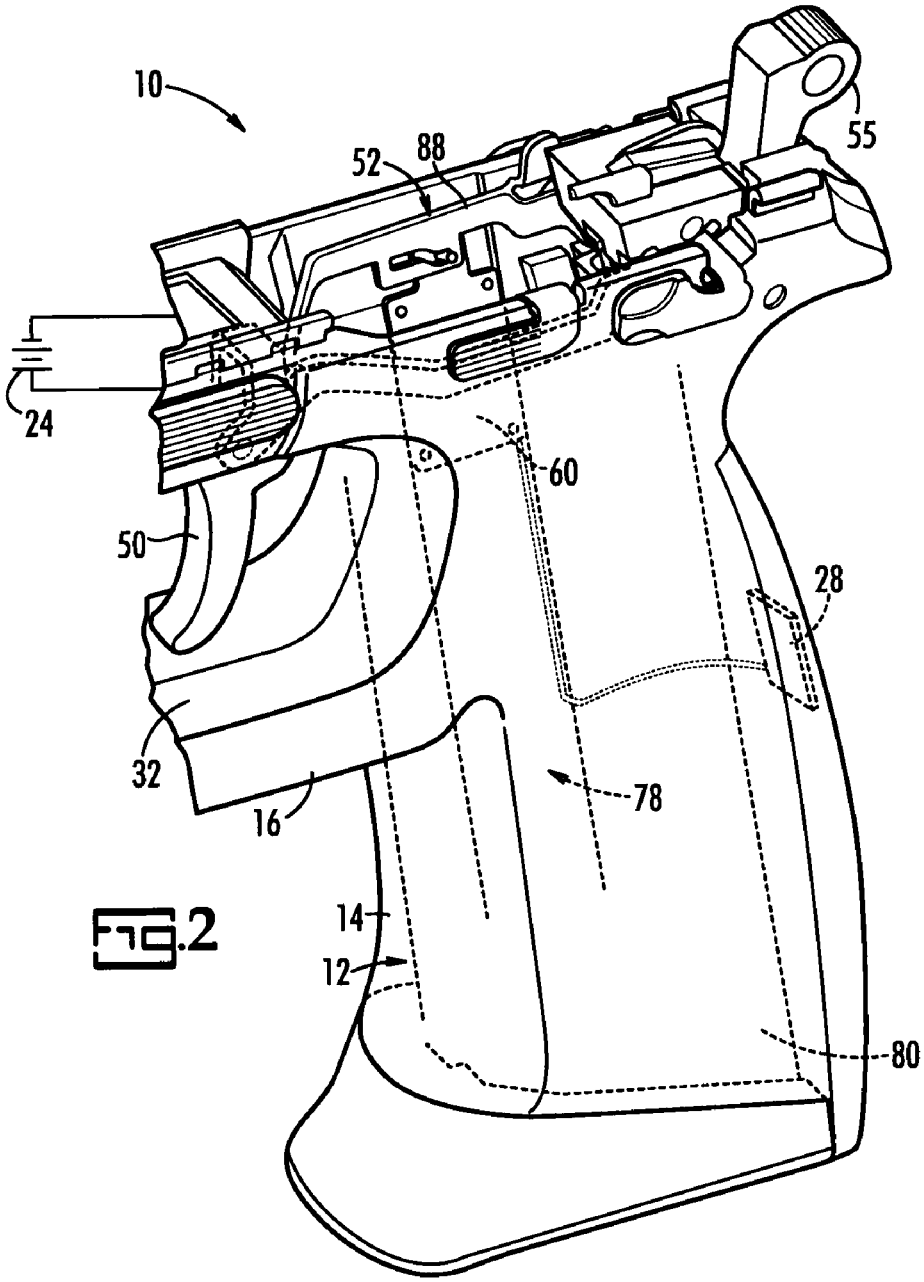
FIG. 2 is a side view of a firearm, according to a preferred embodiment of the present invention, with the firearm partially cut away to show the fire control system with a piezo-electric enabler, according to a preferred embodiment of the present invention.

The present invention is a firearm with an authorization system. The authorization system will disable the firearm so that it will not fire if the user is an unauthorized user. Otherwise, the firearm will fire. The present invention includes a firearm, and an authorization device for emitting an authorizing signal to the firearm when queried by the firearm. The firearm includes a fire control system, a computer controller that communicates with the authorization device, and a piezo-electric-based disabler that responds to the computer controller.

Referring now to the figures, an embodiment of the present firearm 10 with the present authorization system is illustrated. In most respects, firearm 10 is a conventional firearm, here illustrated as a semi-automatic firearm. It has all of the components of a typical firearm, including, for example, a frame 12 with a handle 14 and trigger guard 16, a slide 18, and a barrel 20.

Firearm 10 may carry a power source such as a pair of batteries 24 in frame 12, for example, below barrel 20. The back of handle 14 preferably includes a back strap 26 with a computer controller 28 embedded therein. Also carried by frame 12, in the rear of handle 14, is a transceiver 30 that sends queries and receives signals from an authorization device 32 with its own transceiver 34. Batteries 24 provide power for computer controller, transceiver 30 and other components of the present authorization system. Transceiver 34 does not have any internal battery power. This device is "passive" and a coil internally generates the power required by utilizing the signal received from transceiver 30 to send a responding signal.

Transceivers 30 and 34 can communicate wirelessly, using radio-wave signals. Preferably, these signals are transmitted in such a way so that the orientation of authorizing device 32 and firearm 10 is critical for the effective communication of an authorizing signal. If desired, a small light such as a light emitting diode (LED) 34 can be used to indicate the firearm is ready to fire.

Various switches can be used to initiate the authorization system functions. For example, a holster switch 40 can be used to draw power from batteries 24. Pressure sensors or capacitive sensors 42, 44 and 46 can be used to initiate an authorization query by computer controller 28 of authorizing device 32. Sensors 42, 44, and 46 should be positioned about frame 12, in places where a user's firing hand will make contact. Preferably, switches 42, 44, and 46 are spaced apart and on different sides of handle 14.

Firearm 10 has a fire control system that includes a pivotally mounted trigger 50 and a trigger bar 52 that moves rearward in response to the pulling of trigger 50 (arbitrarly designating the handle-end of firearm 10 as rearward). When trigger bar 52 is moved rearward, it comes into engagement with a hammer link 54 attached to hammer 55, moving it rearward as well. Hammer link 54 loads the hammer against the hammer spring (not shown) until hammer link 54 trips, releasing hammer 55, which is in turn propelled forward at the urging of the hammer spring. The propelled hammer strikes the firing pin that therefore strikes the primer of a cartridge present in the breech block (not shown), detonating the powder in the cartridge base. The exploding powder propels the cartridge bullet through barrel 20. The foregoing is conventional operation for a semi-automatic firearm 10. Also, these components are included in the fire control system: trigger, trigger bar, hammer link and hammer.

In the present system, the authorization system commandeers the fire control system to prevent it from operating in selected circumstances, namely, when the user is not authorized. There are certain conditions, as will be described, when firearm 10 is in a "fire-enabled" mode, and firearm 10 will fire. These include those times when firearm 10 is in its holster, and holster switch 40 is open. Furthermore, according to the present preferred embodiment for police use, the present authorization system, if it should fail, will fail in the "fire-enabled" mode. Thus, for example, if batteries 24 are dead, the police office will be able to fire firearm 10.

As the user grasps handle 14 of firearm 10, the presence of the hand of the user near sensors 42, 44, 46, carried by handle 14 will send a signal to electrical control circuit 28 to initiate the authorization procedure. Sensors 42, 44, and 46 are positioned where a user would have to grip the firearm 10 in order to fire it.

The purpose of multiple grip sensors 42, 44, 46 is to initiate the authorization system based on the premise that firearm 10 is being grasped in a manner that would indicate the holder intends to fire it, rather than merely when it is being touched or carried in some way that would not indicate an intention to fire.

Alternatively pressure sensors 42, 44, 46, may be based on capacitance rather than pressure. When a user touches or is close to the capacitive sensing electrode, the capacitance around the sensing electrode changes dramatically. This activates the authorization system. This system differs from the one based on pressure sensors in following respects. The capacitance-based system is more sensitive than the pressure sensor-based system; the slightest touch or even proximity can activate the authorization system. The capacitance-based system can be calibrated and can auto-calibrate to adjust for changes in conditions such as weather and in the handling of the gun so that the appropriate sensitivity activates the authorization system. Capacitance switches can be added to the handle of the firearm in such a way that the firearm will not need to look any different than one that is not equipped with the present invention. Finally, capacitance switches are more rugged than pressure sensitive switches.

Unlike many prior art authorization systems, however, the user does not have to have a finger on trigger 50 or be in the process of pulling trigger 50 for the authorization system to be activated. Firearm 10 merely has to be in someone's grasp and free of its holster. Thus, the authorization process can be complete well before the need to fire occurs. Computer controller 28 is preferably an integrated circuit, with memory, secured within back strap 26 so that tampering cannot easily defeat the authorization system.

The present authorization system depends on an authorizing signal from authorizing device 32 to firearm 10. Computer controller 28, after any of the switches 42, 44, and 46 are closed, will transmit a coded query and "listen" for a response. The response is most preferably a unique, coded response to the authorized user or users from authorizing device 32. Authorizing device 32 may be worn on or implanted into the user's body. Moreover, it will be clear that technology that allows individuals to be sensed and uniquely identified could be used in lieu of the use of authorizing device 32 to receive an authorizing signal.

Computer controller 28 causes transceiver 30 carried by frame 12 to emit a coded wireless signal in electromagnetic energy (infrared, radio frequency, etc). Transceiver 30 is located to the rear of firearm 10 and oriented so as to emit the burst rearward. If the user is wearing authorizing device 32, it will respond via transceiver 34, carried by device 32, as long as the "code" detected is acceptable. Transceiver 34, on authorizing device 32, will respond by transmitting a coded wireless authorizing signal burst. Preferably these signals from transceivers 30, 34, are limited in strength so that firearm 10 and authorizing device 32 must be close and properly oriented for the authorizing signal to be properly received and result in authorization to fire. Accordingly, firearm 10 cannot be fired when at a distance too great from authorizing device 32 for normal operation.

If an authorizing signal is received from authorizing device 32 by the transceiver 34, and conveyed to computer controller 28, the signal will be decoded and evaluated by computer controller 32 in comparison to pre-designated authorization codes in its memory, and the signal travel time or strength compared to that expected when the signal comes from a distance more than appropriate for normal operation in order to verify that it is a properly received authorization signal.

Many prior art authorization systems use solenoids to block a component of the fire control system of a firearm, such as the trigger, the sear, or the trigger bar. However, the present invention does not block the fire control mechanism; it "disconnects" it. By "disconnecting," it is meant that trigger 50, when disconnected, still moves when pulled, moving trigger bar 52 rearward, but firearm 10 does not fire because hammer link 54 is not moved by trigger bar 52. The fire control system is disrupted because its components are disconnected. "Blocking" on the other hand means that trigger 50 does not move when pulled. This difference is important. If a component of the fire control system is blocked by a solenoid pin, for example, a user who is not authorized may be able by sheer force to break the rod of the solenoid or damage the blocked component and thus defeat the authorization system. In the present system, no amount of force will enable the disconnected fire control system because trigger 50, trigger bar 52 and hammer link 54 are not blocked. They are, however, disconnected so that the fire control system is disrupted and will not allow firearm 10 to fire.

Figure 3A:
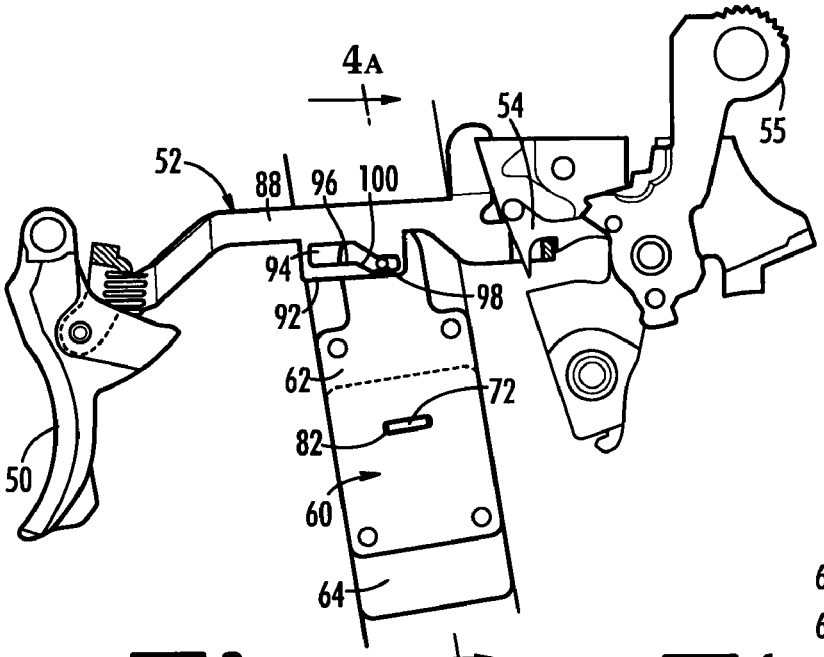
FIGS. 3A, 3B and 3C illustrate, in detail, the structure and operation of the enabler in controlling the trigger bar, with FIGS. 3A and 3B showing the enabler in the "fire enabled" position and FIG. 3C showing the enabler in the "fire disabled" position, according to a preferred embodiment of the present invention.
Figure 4A:
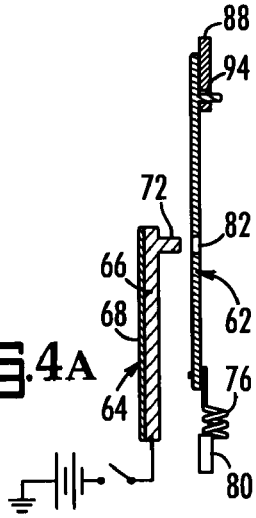
FIGS. 4A, 4B and 4C are detailed end views of the enabler of FIGS. 3A, 3B, and 3C, respectively illustrating its "fire enabled" and "fire disabled" positions.
Figure 3B:
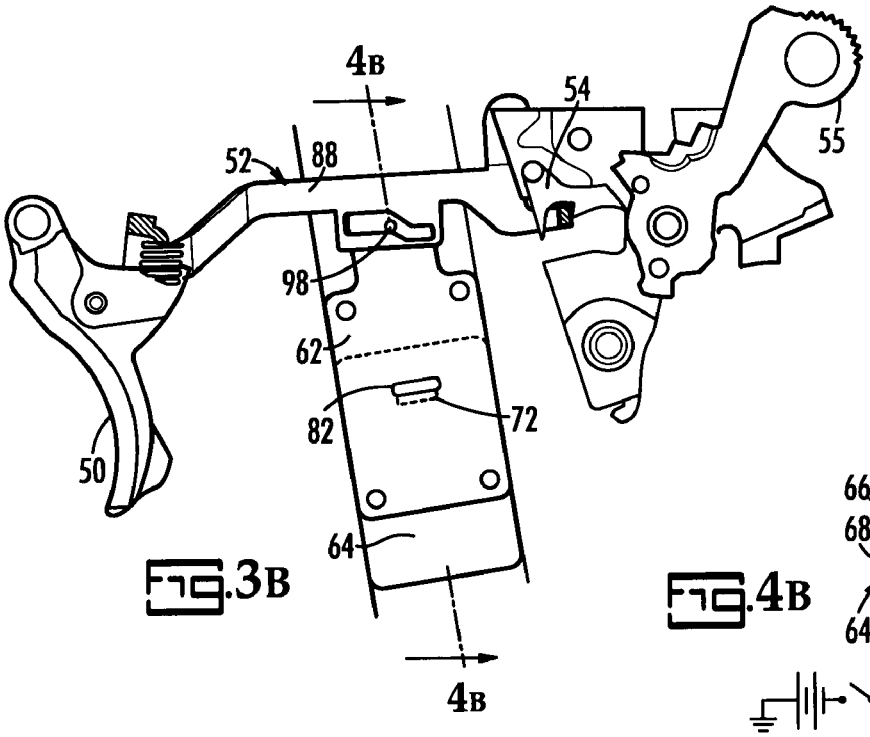
Figure 4B:
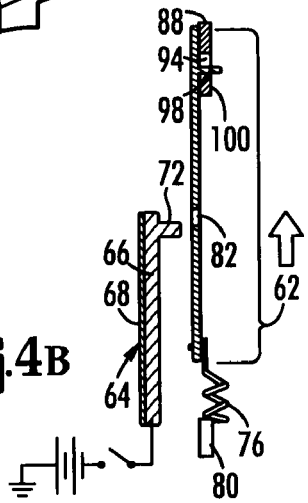
Figure 3C:
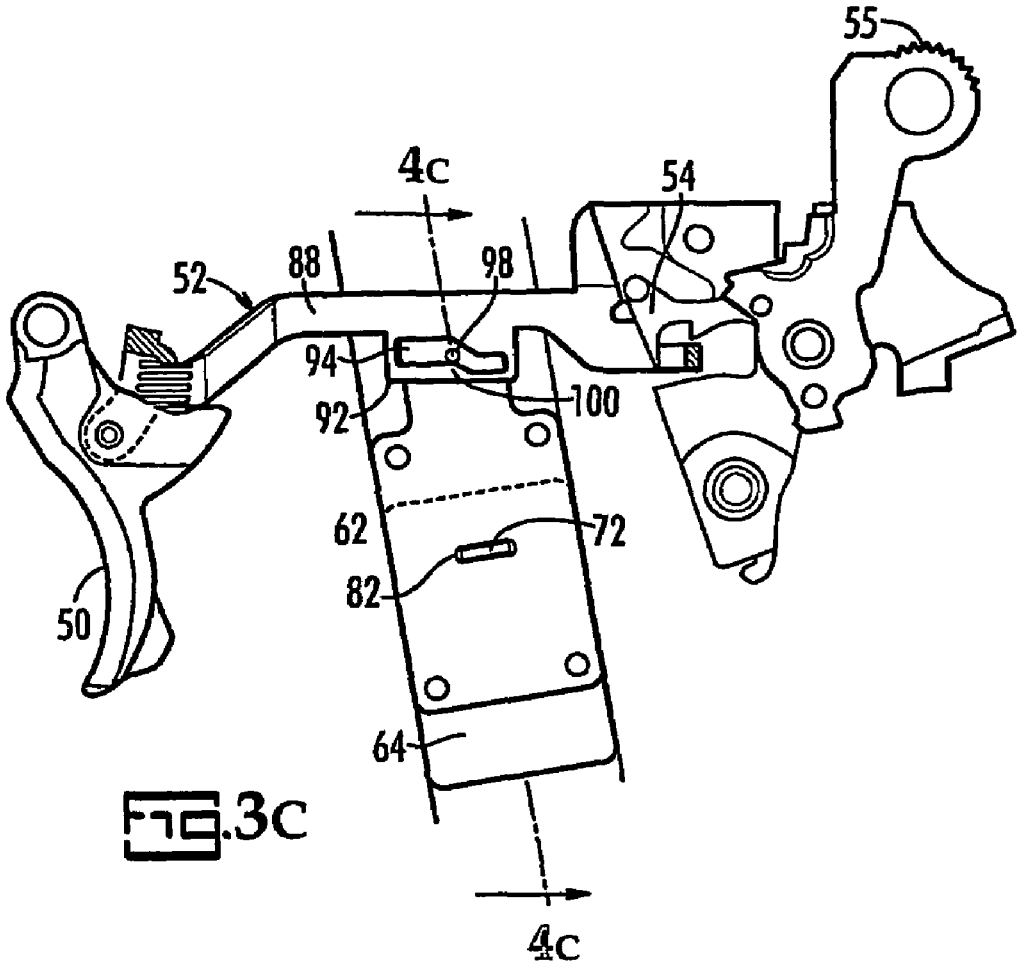
Figure 4C:
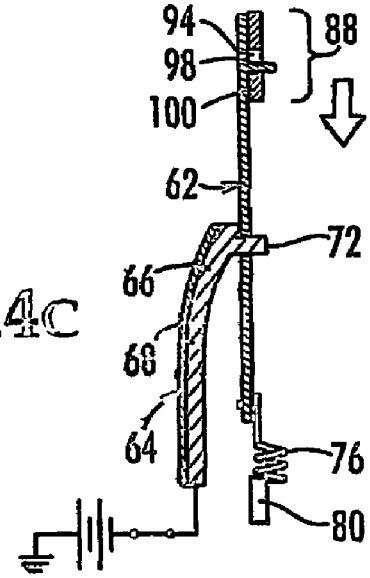

A preferred embodiment of the fire control system is illustrated in the sequence shown in FIGS. 3A-3C. This fire control system includes trigger 50, trigger bar 52, hammer link 54 and hammer 55. Disabler 60, as will now be explained, disrupts this fire control system.

The rearward movement of hammer link 54 (away from barrel 20 and toward handle 14) is controlled by the rearward movement of trigger bar 52, which is, in turn, controlled by the rearward movement of trigger 50. To move hammer link 54 rearward, bar 52 must engage hammer link 54. If, however, trigger bar 52 is depressed to the point where trigger bar 52, during its rearward movement, clears hammer link 54, hammer 55 will not be loaded and firearm will not fire.

Enabler 60 is based on the use of a piezo-electric material. Piezo-electric materials contract on the application of a voltage. Enabler 60 has two members that cooperate to disrupt the fire control system: a first member 62, that has a movable state and a fixed state, and a second member 64, that is attached to frame 12 and contains piezo-electric material 66. Second member 64 is arranged so that piezo-electric material 66 is affixed to a thin metal backing 68 so that, when the small electrical output signal (high voltage and low current) of computer controller 28 is applied to it, second member 64 will bend as the molecules of piezo-electric material 66 try to contract. Second member 64 has a locking projection 72 extending laterally from it at the point where the bending from normal position is greatest.

First member 62 is normally in its movable state. When movable, it is free to move up and down. A spring 76 secures first member 62 within a channel 78 formed in a magazine well 80 within handle 14. First member 62 moves up and down against the urging of spring 76.

First member 62 has a hole 82 formed therein dimensioned to receive locking projection 72. When an electrical output signal from computer controller 28 is applied to second member 64, second member 64 responds by bending toward first member 62. Locking projection 72, carried by second member 64, enters hole 82 on first member 62, preventing first member 62 from moving up and down and thereby changes the state of first member 62 from its movable state to its fixed state.

Trigger bar 52 has two arms 88, 90. A tab 92 with a cutout portion 94 extends from one arm, arm 88. Cutout portion 94 has a shape that defines a cam edge 96. First member 62 has a camming projection 98 that extends into cutout portion 94 and engages trigger bar 52 along cam edge 96. Cam edge 96 has a rise 100 formed thereon. As trigger bar 52 moves rearward in response the user's pull on trigger 50, camming projection 98 follows cam edge 96, riding up rise 100.

When first member 62 is in its movable state, and thus free to move up and down, and trigger bar 52 is moved rearward, cam edge 96 of trigger bar 52 moves rearward essentially unhindered. Spring 76 allows first member 62 to be lifted easily as camming projection 98 rides on cam edge 96. Trigger bar 52, in its normal rearward travel, engages hammer link 54 and thus the fire control system operates normally and the bullet will be fired through barrel 20.

When first member 62 is in its fixed state, however, and trigger bar 52 is moved rearward, camming projection 98 will push cam edge 96 down, and trigger bar 52 with it, as its rides up rise 100. Rise 100 is positioned so that trigger bar 52 clears hammer link rather than engages it. Hammer link 54 is therefore not moved and the fire control system has been disrupted. Firearm 10 will not fire. Trigger 50 can be pulled repeatedly but trigger bar 52 will not engage hammer link 54, being cammed clear of it by disabler 60 as long as there is an electrical output signal from computer controller 28.

The logic of this operation is programmed into computer controller 28. In particular signals from holster switch 40 and sensors 42, 44, 46, will cause computer controller 28 to query authorizing device 32 for an authorizing signal. Once that authorizing signal is received, firearm 10 remains in a "fire-enabled" mode. If no signal is received within a pre-selected time, computer controller 28 will send the electrical output signal to disabler 60. The electrical output signal will cause second member 64 to bend so that locking projection 72 enters the hole 82 on first member, thus placing it in its fixed state. Accordingly, first member 62's camming projection will follow cam edge, camming trigger bar 52 down when it reaches rise 100 so that trigger bar 52 clears hammer link 54, and firearm will thus be in the "fire-disabled" mode.

It will be apparent to those skilled in firearm authorization systems that many modifications and substitutions can be made to the foregoing preferred embodiments without departing from the spirit and scope of the present invention, defined by the appended claims.

What is claimed is:

1. A firearm authorization system, comprising:

(1) a firearm having a frame with a handle, a barrel carried by said frame, and a fire control system carried by said frame and in operational connection with said barrel, said fire control system adapted to fire a bullet through said barrel;

(2) a computer controller carried by said frame and adapted to receive and evaluate signals, said computer controller emitting an electrical output signal when said computer controller does not receive an authorizing signal;

(3) a disabler carried by said frame and in operational connection with said fire control system, said disabler being responsive to said electrical output signal so that, when said computer controller emits said electrical output signal, said disabler thereupon disconnects said fire control system so that said fire control system is prevented from firing said bullet;

(4) a first member having a movable state and a fixed state, and carrying a camming protection that engages said fire control system, said camming projection of said first member camming fire control system when said first member is in said fixed state; and (5) a second member that bends in response to said electrical output signal, said second member, when bent, holding said first member in said fixed state, and, when said second member is not bent, allowing said first member to remain in said movable state.

2. The firearm authorization system as recited in claim 1, wherein said first member further comprises a spring, and wherein said first member, when in said moving state, moves against the urging of said spring.

3. The firearm authorization system as recited in claim 1, wherein said first member has a hole formed therein and said second member has a locking projection dimensioned to fit within said hole, so that when said second member is bent, said locking projection is received within said hole and thereby holds said first member in said fixed state.

4. The firearm authorization system as recited in claim 1, wherein said handle has a magazine well formed therein, and wherein said disabler is carried by said magazine well.

5. The firearm authorization system as recited in claim 1, further comprising an authorizing device adapted to transmit an authorizing signal to said computer controller.

6. The firearm authorization system as recited in claim 5, wherein said computer controller is adapted to query said authorizing device for said authorizing signal.

7. The firearm authorization system as recited in claim 6, further comprising a sensor switch for causing said computer controller to query said authorizing device, said sensor switch closed by holding said firearm.

8. The firearm authorization system as recited in claim 6, further comprising a power source carried by said frame.

9. The firearm authorization system as recited in claim 8, further comprising a power switch carried by said frame and adapted to cause power to be drawn from said power source, said power switch closed by removing said firearm from a holster.

10. The firearm authorization system as recited in claim 1, wherein said authorizing device is remote from said computer controller.

11. The firearm authorization system as recited in claim 1, wherein said second member is made of a piezo-electric material that bends in response to application of said electrical output signal.

* * * * *